US009177501B2

(12) United States Patent
Moriwaki

(10) Patent No.: US 9,177,501 B2
(45) Date of Patent: Nov. 3, 2015

(54) DISPLAY APPARATUS HAVING A BENDABLE SUBSTRATE AND CONTROL METHOD OF THE DISPLAY APPARATUS

(75) Inventor: Toshiki Moriwaki, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 195 days.

(21) Appl. No.: 12/950,313

(22) Filed: Nov. 19, 2010

(65) Prior Publication Data

US 2011/0134144 A1 Jun. 9, 2011

(30) Foreign Application Priority Data

Dec. 4, 2009 (JP) ..... 2009-276945

(51) Int. Cl.
*G09G 5/00* (2006.01)
*G09G 3/32* (2006.01)

(52) U.S. Cl.
CPC ..... *G09G 3/3208* (2013.01); *G09G 2300/0426* (2013.01); *G09G 2340/0464* (2013.01); *G09G 2380/02* (2013.01)

(58) Field of Classification Search
CPC ..... G06F 1/1652; G09G 3/3208; G09G 2300/0426; G09G 2340/0464; G09G 2380/02
USPC ..... 345/156, 660, 698, 204
See application file for complete search history.

(56) References Cited

U.S. PATENT DOCUMENTS

| | | | | |
|---|---|---|---|---|
| 6,243,075 | B1 * | 6/2001 | Fishkin et al. | 345/156 |
| 7,557,875 | B2 * | 7/2009 | Majumdar et al. | 349/89 |
| 7,782,274 | B2 * | 8/2010 | Manning | 345/1.3 |
| 2003/0071832 | A1 * | 4/2003 | Branson | 345/698 |
| 2003/0098857 | A1 * | 5/2003 | Gettemy et al. | 345/173 |
| 2003/0227441 | A1 | 12/2003 | Hioki et al. | |
| 2006/0274036 | A1 * | 12/2006 | Hioki et al. | 345/156 |
| 2008/0291225 | A1 | 11/2008 | Arneson | |
| 2010/0056223 | A1 * | 3/2010 | Choi et al. | 455/566 |
| 2010/0164888 | A1 * | 7/2010 | Okumura et al. | 345/173 |
| 2010/0164973 | A1 * | 7/2010 | Huitema et al. | 345/581 |
| 2011/0227822 | A1 * | 9/2011 | Shai | 345/156 |
| 2012/0115422 | A1 * | 5/2012 | Tziortzis et al. | 455/73 |
| 2015/0173172 | A1 * | 6/2015 | Yang et al. | 361/749 |
| 2015/0173212 | A1 * | 6/2015 | Lee et al. | 315/291 |

FOREIGN PATENT DOCUMENTS

| | | |
|---|---|---|
| JP | 2002-278515 | 9/2002 |
| JP | 2005-173193 | 6/2005 |
| JP | 2006-243621 | 9/2006 |
| JP | 2007-048237 | 2/2007 |
| JP | 2007-240617 | 9/2007 |
| JP | 2009-181572 | 8/2009 |

OTHER PUBLICATIONS

Sony Corporation; EP Application No. 10015050.7; European Extended Search Report, mailed Feb. 18, 2011; 9 pages.

* cited by examiner

*Primary Examiner* — Xiao Wu
*Assistant Examiner* — Michael J Cobb
(74) *Attorney, Agent, or Firm* — Dentons US LLP

(57) ABSTRACT

An apparatus includes a bendable substrate, light-emitting elements, a sensor, and a display controller. The display controller is configured to control the light-emitting elements at least in part based upon a bending of the substrate, which is detected by the sensor.

25 Claims, 8 Drawing Sheets

| DISPLACEMENT SENSOR DETECTION AMOUNT | IMAGE AREA CONTROL AMOUNT |
|---|---|
| 0 | 0 |
| 0.1 V | REDUCTION BY 6% |
| 0.2 V | REDUCTION BY 10% |
| 0.3 V | REDUCTION BY 18% |
| 0.4 V | REDUCTION BY 27% |
| ⋮ | ⋮ |

DISPLAY APPARATUS HAVING A BENDABLE SUBSTRATE AND CONTROL METHOD OF THE DISPLAY APPARATUS

RELATED APPLICATION DATA

The present application claims priority to Japanese Patent Application JP 2009-276945, filed in the Japan Patent Office on Dec. 4, 2009, which is incorporated herein by reference in its entirety to the extent permitted by law.

BACKGROUND OF THE INVENTION

The present invention relates to a display apparatus and a control method of the display apparatus.

Recently, it has been important to ensure reliability of display elements in a display apparatus. Particularly, ensuring structural and mechanical reliability in terms of display performance is still a necessary item, which is the same as it was in the past.

For example, in Japanese Unexamined Patent Application Publication No. 2005-173193 as follows, in order to suppress a reduction in life-span of elements due to temperature increase due to the current amount, controlling a horizontal scanning line to be lit on or off so as to suppress overcurrent by using data, such as image data which can be used to determine a display state of a device, to determine circumstances of an image, is proposed as a technique.

However, in the technique disclosed in Japanese Unexamined Patent Application Publication No. 2005-173193, very complex control is performed to combine a gate signal and a source signal, and various feedback control operations such as controlling a lighting period are performed, so that many algorithms are used. Therefore, there is a problem in that manufacturing cost is increased in order to ensure reliability. In addition, control using complex algorithms results in an increase in power consumption of a driver IC, which generates degradation of power performance.

In Japanese Unexamined Patent Application Publication No. 2007-240617, a technique is disclosed for controlling optical characteristics such as the index of refraction by quantitatively detecting an amount of change of deformation due to a small force on a display apparatus, using an optical detecting unit of a polarization detecting device as a change in a polarized state of incident light.

In the technique disclosed in Japanese Unexamined Patent Application Publication No. 2007-240617, when there is light scattering in terms of relatively intensive external light from other light sources, for example sunlight or an indoor fluorescent light, or noise due to reflection of the external light, it is difficult to detect a small index of refraction caused by deformation.

SUMMARY OF THE INVENTION

Disclosed herein are one or more inventions that are capable of ensuring display reliability during curvature by performing display control in response to an amount of curvature when there is curvature in a display apparatus having flexibility.

In an embodiment, an apparatus includes a bendable substrate, light-emitting elements, and a sensor. The light-emitting elements are carried on the substrate. The sensor is configured to detect a bending of the substrate. The display controller is configured to control the light-emitting elements at least in part based upon the bending of the substrate, as detected by the sensor.

In an embodiment, a display apparatus includes a display unit and a display controller. The display unit has a display area to display at least one image. The display unit includes a bendable substrate, light-emitting elements carried on the substrate, and a sensor configured to detect bending of the substrate. The display controller controls said light-emitting elements at least in part based upon the bending of said substrate detected by the sensor.

In an embodiment, a display apparatus includes a display unit. The display unit has a display area to display at least one image. The display unit includes a bendable substrate, display elements, and a sensor. The substrate is configured to bend and flex into a number of different positions. The display elements are carried on the substrate. The sensor is configured to detect an amount of curvature of the substrate when it is bent. A size of the display area is controlled based upon the amount of curvature of the substrate. The display area comprises active display elements.

In an embodiment, a method includes detecting an amount of bending of a bendable substrate of a display unit, and controlling a size of a display area of active light-emitting elements at least in part based upon the bending of said substrate.

As described above, embodiments of the present invention are able to provide a display apparatus and a control method of the display apparatus capable of ensuring display reliability while bending and/or unbending a display apparatus by performing display control in response to an amount of curvature of a display apparatus having flexibility.

DESCRIPTION OF THE PRESENTLY PREFERRED EMBODIMENTS

Figure 1:
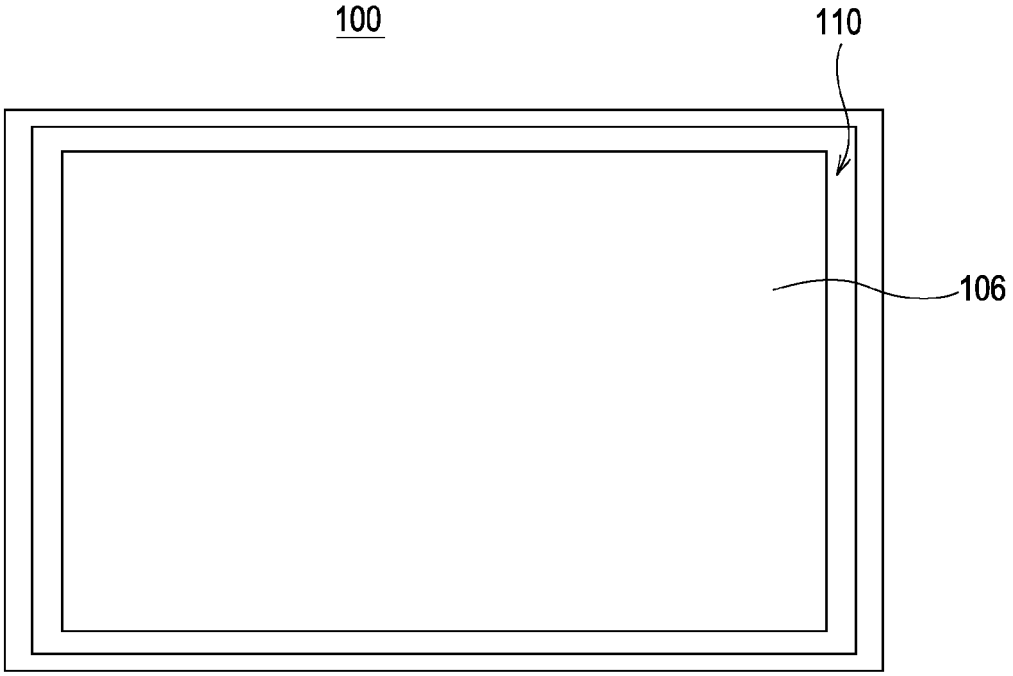
FIG. 1 is a plan view illustrating a front surface of a display apparatus according to an embodiment of the invention.

Hereinafter, exemplary embodiments will be described in detail with reference to the accompanying drawings. In addition, throughout the specification and figures, like configuration elements practically having the same functional configurations are denoted by like reference numerals, and detailed description thereof will be omitted.

In addition, the description will be provided in the following order:

1. Example of Configuration of Display Apparatus
2. Functional Block Configuration of Display Apparatus
3. Functional Block Configuration of Control Unit
4. Example of Configuration providing Displacement Sensors on Front and Rear Surfaces
5. Another Example of Lookup Table 1. Example of Configuration of Display Apparatus First, a schematic configuration of a display apparatus 100 according to an embodiment of the invention will be described with reference to FIGS. 1 and 2. FIG. 1 is a plan view illustrating a front surface of the display apparatus 100. The display apparatus 100 includes a display unit 110 which is configured by semiconductor layers described later and in which a plurality of pixels are arranged in matrices. The display unit 110 displays images such as a still image or a moving image by allowing each pixel to emit light in response to a video signal.

In this embodiment, since flexibility characteristics are able to be exhibited by the display unit 110, the display unit 110 which displays images on the display apparatus 100 in response to a displacement detection amount with respect to an amount of curvature at the time of bending or causing the curve to occur, is controlled to change a size of an image display area which is an area for displaying images, thereby ensuring display reliability.

Figure 2:
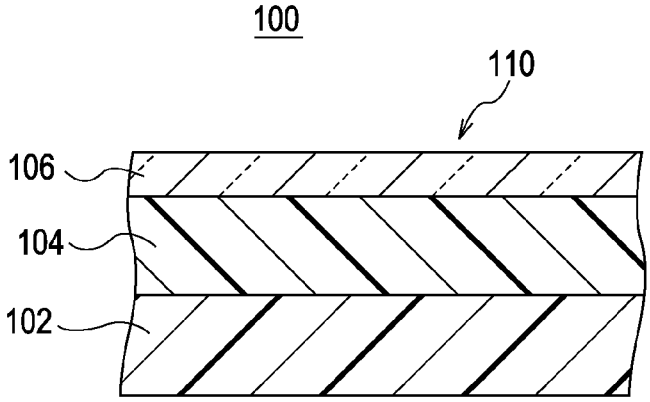
FIG. 2 is a diagram schematically illustrating a cross-section of the display apparatus.

FIG. 2 is a diagram schematically illustrating a cross-section of the display apparatus 100. As illustrated in FIG. 2, in this embodiment, a first substrate 102, a second substrate 104, and a displacement sensor 106 are laminated to constitute the extremely thin display apparatus 100 having a thickness of a few tens of micrometers. The first substrate 102 is configured by forming display elements (light-emitting elements) used for configuring each pixel on a flexible substrate (e.g., a bendable substrate), for example, a plastic substrate made of resin, and as the display element, an organic semiconductor or inorganic semiconductor element which can be formed by a low-temperature process may be used. In this embodiment, an organic EL (electroluminescence) element may be formed on the first substrate 102 as the display element.

The second substrate 104 is a plastic substrate made of resin and is disposed to oppose the first substrate 102 having the display element made of the organic semiconductor or inorganic semiconductor to function as a sealing substrate for sealing the display element. The second substrate 104 may be a flexible substrate (e.g., a bendable substrate). As described above, in this embodiment, the display apparatus 100 is configured by pinching the semiconductor layer with the two types of substrates including the first and second substrates 102 and 104. The display unit 110 on which images are displayed becomes a surface on the second substrate 104 side. In addition, with such a configuration, the display apparatus 100 is configured to have a thickness of a few tens of micrometers and thus has flexibility and is bendable in a number of different positions, so that the display apparatus 100 can be freely curved or bent while displaying images.

As illustrated in FIGS. 1 and 2, arranged on the surface of the second substrate 104 are the displacement sensors 106 made of a transparent electrode body, for example, an ITO film (Indium Tin Oxide) or an IZO film (Indium Zinc Oxide). The displacement sensor 106 is formed on the same area as, for example, the display unit 110. The displacement sensor 106 is made of the transparent electrode body and is arranged to oppose each of the display elements of the first substrate 102.

The displacement sensor 106 is configured as, for example, an electrode of an existing touch panel, two sheets of metal thin film (resistance films) made of transparent electrodes such as ITO or IZO are disposed to oppose each other, and a plurality of pairs of the metal thin films is disposed on the plane area, for example, in a matrix form. The opposed transparent electrodes of the displacement sensor 106 have resistance, and the one electrode thereof is applied with a predetermined voltage so that a resistance value between the electrodes is monitored. In this configuration, as the display apparatus 100 is curved, the resistance value between the two sheets of the metal thin films changes at the curved position, and a voltage occurs in the other electrode in response to the curvature, thereby detecting the change in the resistance value. Therefore, from among the plurality of pairs of metal thin film arranged in a matrix form, the metal thin film where there is a change in the resistance value is detected, so that a displaced position of the displacement sensor 106 can be detected, thereby detecting a position at which the display unit 110 is curved. The displacement sensor may be configured to detect a position associated with the detected curvature and/or a location of the bending. In addition, the change in the resistance value is increased with the increase in the amount of curvature of the display apparatus 100. In this manner, the display apparatus 100 can detect the amount of change in resistance detected by the displacement sensor 106, and detect the curved position (e.g., the location of the bending) and the amount of curvature of the display apparatus 100.

Figure 3:
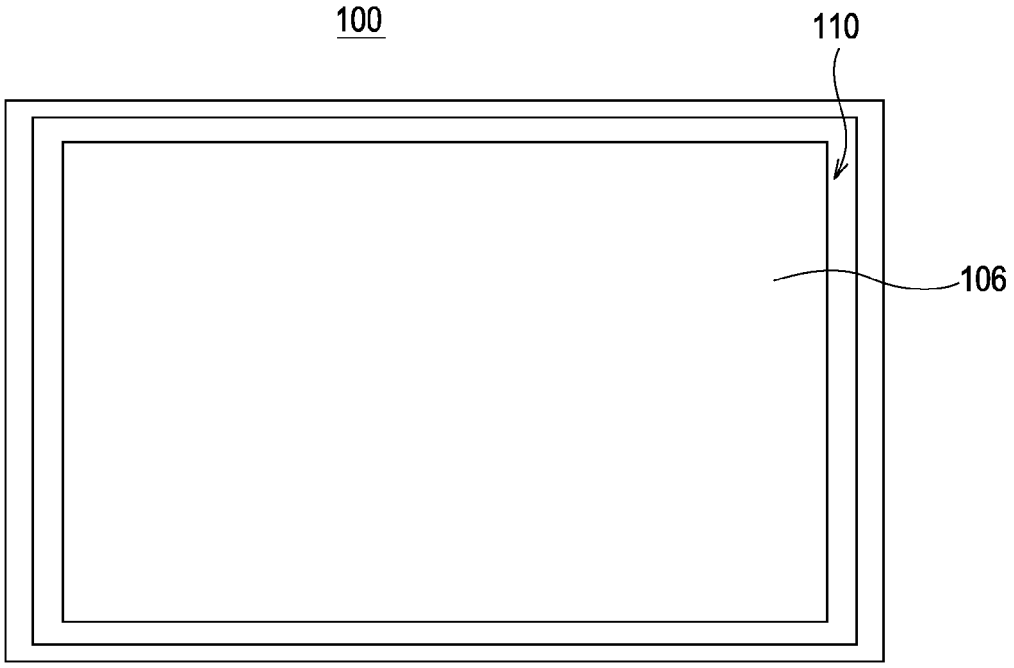
FIG. 3 is a diagram illustrating an example in which a displacement sensor is provided on a rear surface of a display unit and illustrating a rear surface of the display apparatus in a plan view.
Figure 4:
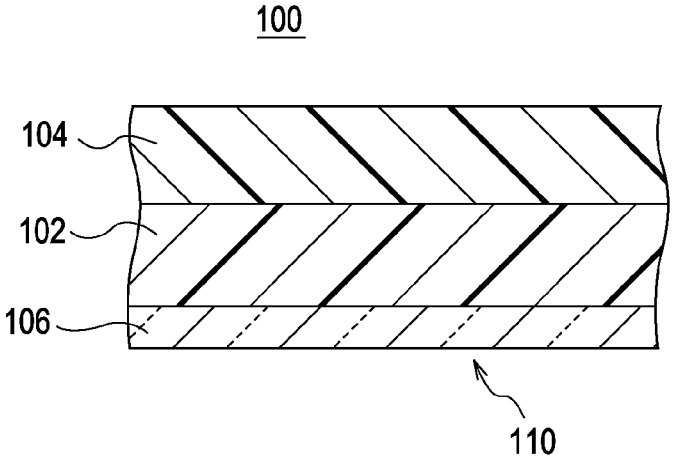
FIG. 4 is a diagram illustrating the example in which the displacement sensor is provided on the rear surface of the display unit and schematically illustrating a cross-section of the display apparatus.

FIGS. 3 and 4 are diagrams schematically illustrating an example in which the displacement sensor 106 is provided on a rear surface of the display unit 110. Here, FIG. 3 is a plan view illustrating the rear surface of the display apparatus 100, and FIG. 4 is a cross-sectional view illustrating the display apparatus 100. In the configurations illustrated in FIGS. 3 and 4, the configurations of the first and second substrates 102 and 104 are the same as those of the display apparatus 100 illustrated in FIGS. 1 and 2. In this configuration example, as illustrated in FIG. 4, the displacement sensor 106 is provided on the rear surface of the first substrate 102. In the case where the displacement sensor 106 is provided on the rear surface of the display unit 110, as in the case where the displacement sensor 106 is provided on the front surface of the display unit 110, the amount of curvature and the curved position (e.g., location of the bending) of the display apparatus 100 can be detected in response to the change in the resistance value.

The schematic configuration of the display apparatus 100 according to the embodiment of the invention has been described above. The display apparatus 100 illustrated in FIGS. 1 to 4 has a thickness of about a few tens of micrometers as described above and has flexibility. In other words, the display apparatus 100 is configured to bend and flex into a number of different positions, as desired. Therefore, the display apparatus 100 can be curved by a user. However, when the display apparatus 100 is curved, there is a low possibility that the same displayed state as the state of not being curved is maintained. This is because visibility of the display unit 110 is generally degraded when the display state does not change as a result of the curvature of the display apparatus 100.

Figure 5:
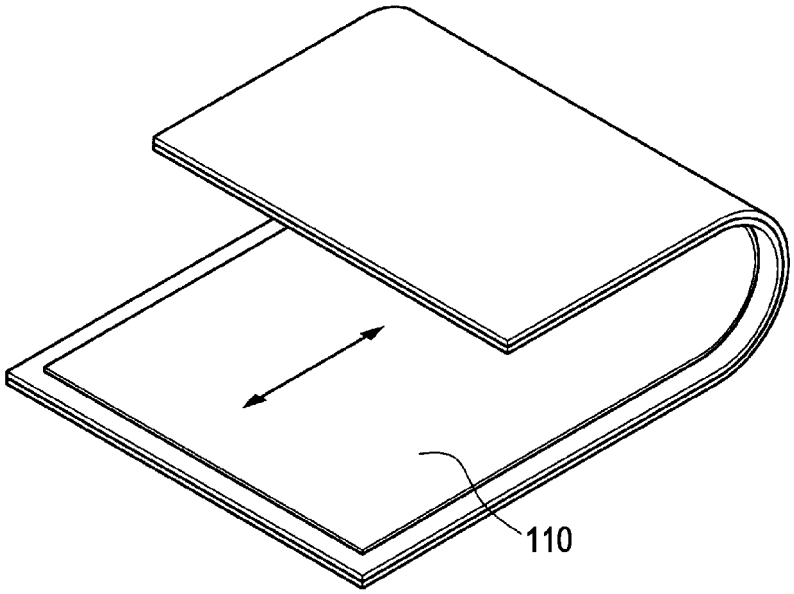
FIG. 5 is a diagram illustrating a curved state of the display apparatus and schematically illustrating a state where the front surface on which the display unit is provided is curved to be a concave surface.

FIG. 5 is a diagram schematically illustrating the curved state of the display apparatus 100 and illustrates a state where the front surface provided with the display unit 110 is curved to be a concave surface. In addition, FIG. 6 illustrates a state where the surface provided with the display unit 110 is curved to be a convex surface.

Figure 6:
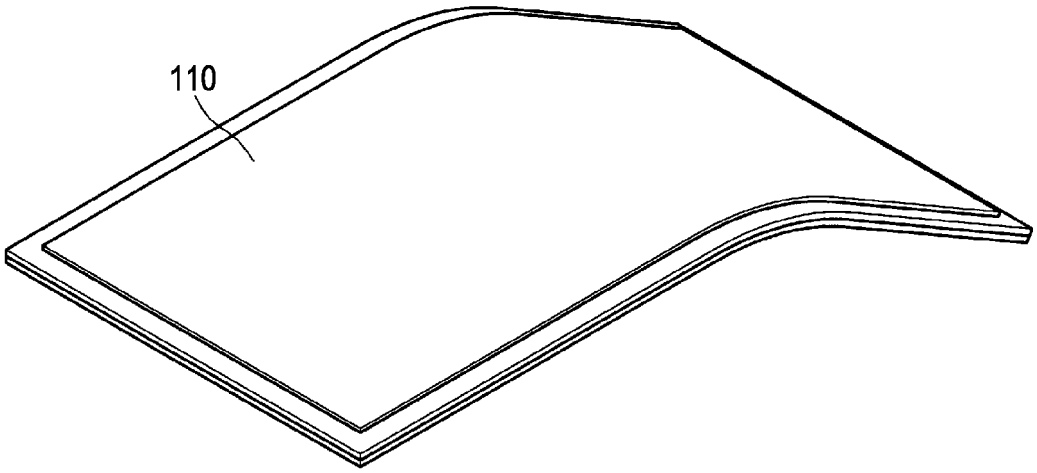
FIG. 6 is a diagram schematically illustrating a state where the surface on which the display unit is provided is curved to be a convex surface.

As illustrated in FIGS. 5 and 6, when the display apparatus 100 is curved, visibility of the display unit 110 is degraded when the display state is not changed as a result of the curvature. In addition, there is a reduction in the necessity to maintain the same image display state as the general state. For example, as illustrated in FIG. 5, when the display screen is curved to be the concave surface, images on the display screen are also curved. In addition, due to an influence of diffuse reflection from the front surface, image quality is degraded compared to a case of a flat surface. For this reason, in order to enhance visibility for the user, the display apparatus 100 reduces the image display area for displaying images on the display unit 110 and controls images to be displayed on a part that is not curved.

For example, as shown in FIG. 5, when the display screen of the display unit 110 is curved at an angle of about 180°, there is an area where the images of the display unit 110 are not visible from the outside when the display area is in its normal state. However, for the curved state shown in FIG. 5, embodiments of the present invention are configured to control and/or reduce, if necessary, the image display area to ensure that the entire display area is visible to the user. In the same manner, as in FIG. 6, when the display screen of the display unit 110 is curved to be a convex surface, images on the display screen are also curved, and thus image quality is degraded. Therefore, by controlling a size of the image display area in accordance with the bending and/or unbending of the substrate, as disclosed by embodiments herein, visibility for the user can be ensured. As described above, in this embodiment, since there is a reduction in the necessity to maintain the image display state before the curvature when the display unit 110 is curved, the images displayed on the display unit 110 are controlled. Specifically, as described above, in order to enhance visibility for the user, the image display area for displaying the images on the display unit 110 is controlled (e.g., reduced from a predetermined maximum size) so that the images are displayed on a part which is not curved. Accordingly, without any discomfort of the user, it is possible to ensure the display reliability in the display apparatus 100 having flexibility during the curvature.

2. Functional Block Configuration of Display Apparatus

Figure 7:
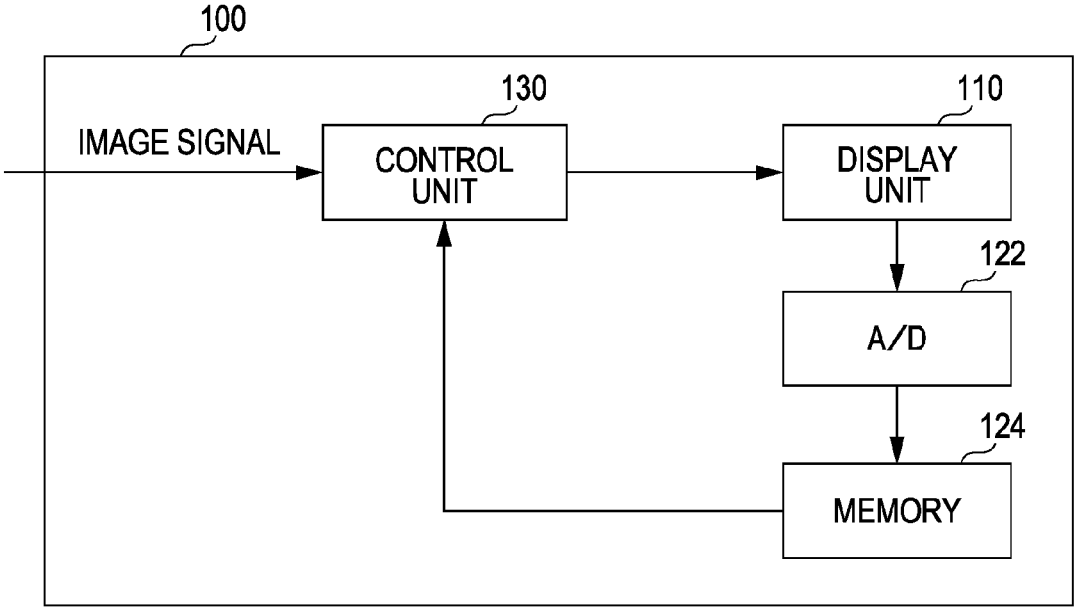
FIG. 7 is a block diagram illustrating a functional configuration of the display apparatus according to an embodiment.

A control technique will now be described in detail. FIG. 7 is a block diagram illustrating a functional configuration of the display apparatus 100 according to an embodiment. Hereinafter, the functional block configuration of the display apparatus 100 will be described with reference to FIG. 7.

As illustrated in FIG. 7, the display apparatus 100 according to the embodiment includes the display unit 110, an A/D converter 122, a memory 124, and a control unit 130. The display unit 110 has, as illustrated in FIGS. 1 to 4, a laminated structure of the first substrate 102, the second substrate 104, and the displacement sensor 106. The A/D converter 122 converts the amount of curvature of the display unit 110 detected by the displacement sensor 106 as an analog amount into a digital amount. The memory 124 temporarily stores the amount of curvature of the display unit 110 converted by the A/D converter 122 into the digital amount. The control unit 130 controls the image display area in the display unit 110 in various ways using the amount of curvature of the display unit 110 stored in the memory 124.

The displacement sensor 106 is made of the transparent ITO film, the IZO film, or the like as described above, and the ITO film or the IZO film has resistance. When a voltage is applied to one of the two opposed resistance films, a voltage corresponding to the position operated by the user for the display unit 110 occurs in the opposing resistance film. By detecting this voltage, the displacement sensor 106 can detect the position of curvature as an analog amount. Therefore, as the amount of curvature of the display unit 110 is detected by the displacement sensor 106 as the analog amount, the detection can be used by the control unit 130 for determining whether or not the display unit 110 is curved.

Moreover, in the configuration illustrated in FIG. 7, the amount of curvature of the display unit 110 converted by the A/D converter 122 into the digital amount is temporarily stored in the memory 124; however, the configuration is not limited to the example according to the embodiment of the invention. For example, the configuration may be implemented so that the amount of curvature of the display unit 110 converted by the A/D converter 122 into the digital amount may be directly supplied to the control unit 130.

3. Functional Block Configuration of Control Unit

Figure 8:
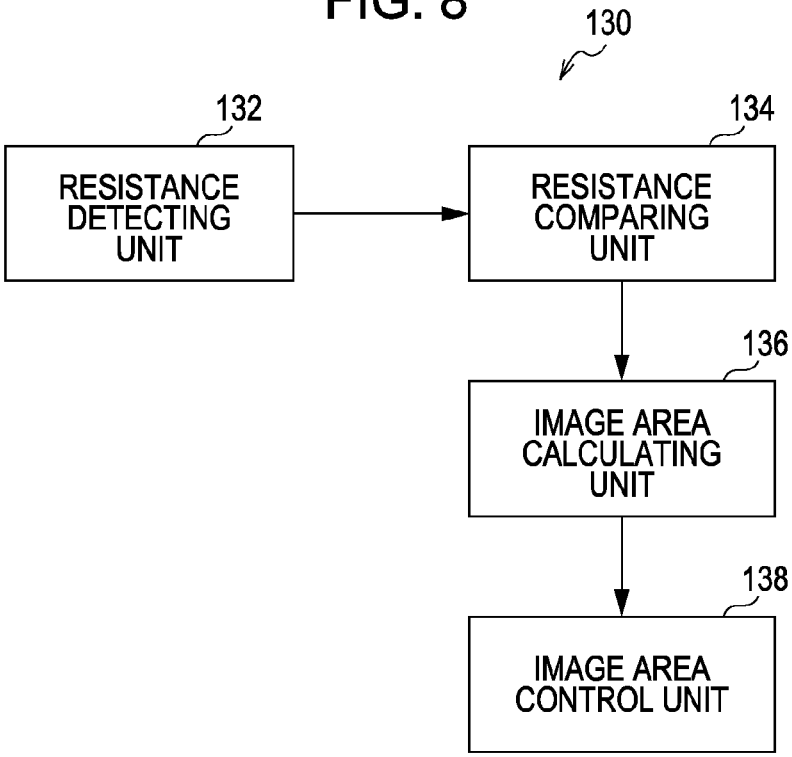
FIG. 8 is a block diagram illustrating a functional configuration of a control unit according to an embodiment.

The functional block configuration of the display apparatus 100 has been described above with reference to FIG. 7. Next, a functional block configuration of the control unit 130 shown in FIG. 7 will be described. FIG. 8 is an explanatory view illustrating the functional block configuration of the control unit 130.

The functional block of the control unit 130 illustrated in FIG. 8 is configured by hardware such as sensors and circuits, a central processing unit (CPU), and software (e.g., programs and/or computer readable medium having instructions thereon) for operating the CPU. As illustrated in FIG. 8, the control unit 130 includes a resistance detecting unit 132, a resistance comparing unit 134, an image area calculating unit 136, and an image area control unit 138.

The resistance detecting unit 132 detects a resistance value output from the displacement sensor 106. The resistance value detected by the resistance detecting unit 132 is sent to the resistance comparing unit 134.

The resistance comparing unit 134 compares a reference resistance value in the flat surface state in which the display apparatus 100 is not curved (i.e., unbent state) to the resistance value detected by the resistance detecting unit 132. As the resistance comparing unit 134 calculates an amount of change in the resistance values by comparing the resistance values to each other, a degree of curvature of the display apparatus 100 can be detected. Information on the amount of change in the resistance values (also referred to herein as "resistance change amount") calculated by the resistance comparing unit 134 is sent to the image area calculating unit 136.

The image area calculating unit 136 determines and outputs an image area control amount used for performing control processing on the image display area by the image area control unit 138, using the amount of change in the resistance value calculated by the resistance comparing unit 134. As the resistance comparing unit 134 detects a predetermined detection voltage, the image area calculating unit 136 determines that it is difficult for the display unit 110 to display images in a normal state (an unbent state in which the display area is at its maximum size) and calculates and determines a degree of the image display area to be reduced from its maximum size. The image area control unit 138 performs image area control processing to control the size of the image display area that displays images on the display unit 110 using an image area control amount determined by the image area calculating unit 136. The image area calculating unit 136 may determine the image area control amount for an area corresponding to the curved part in which the resistance change is detected from among the plurality of the displacement sensors 106 arranged in a matrix form. In addition, the image area control unit 138 may perform the image area control processing on the area corresponding to the curved part on the basis of position information on the displacement sensor 106 with the resistance change, which is input from the resistance comparing unit 134.

Figures 9, 10:
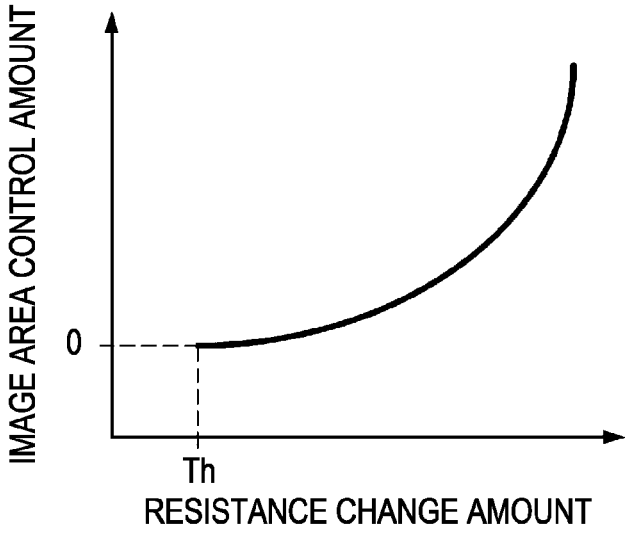
FIG. 9 is a diagram that graphically represents information corresponding to an example of an LUT for defining an image display area in response to an amount of change in resistance.
FIG. 10 is a diagram schematically illustrating another example of the LUT for defining a display area control amount.

In the image area calculating unit 136, the image area control amount to be controlled in response to the amount of change in resistance may be stored as a lookup table (LUT) in advance. FIG. 9 is an explanatory view illustrating an example of a relationship between the amount of change in resistance ("resistance change amount") and the image area control amount stored in the lookup table. As illustrated in FIG. 9, in this embodiment, the image area control processing is performed using the data stored in advance.

As shown in FIG. 9, the image control amount may refer to an amount of change in the size of the selected display area with respect to a maximum size of the display area of the display unit 110. As illustrated in FIG. 9, when the resistance change amount is small, the image area control amount is small, that is, the image display area of the display unit 110 is set to be wide. In addition, the image area control amount is increased as the amount of change in resistance increases, that is, the image display area of the display unit 110 is set to be narrow.

In other words, when the change in resistance values (difference between the detected resistance value and the reference resistance value) is small, the amount of change in the size of the display areas is also small. When the change in resistance values is large, then the amount of change in the size of the display areas is greater than when the change in resistance values is small. Accordingly, when the curvature of the display unit 110 is large, the image area control amount is increased to narrow the image display area of the display unit 110, thereby ensuring visibility of the display unit 110 and maintaining high display performance. On the other hand, when the amount of curvature of the display unit 110 is small, the image area control amount is reduced to widen the image display area of the display unit 110, thereby suppressing the image area control from being recognized by the user.

FIG. 10 is a diagram schematically illustrating another example of the LUT for defining the image area control amount. In the example illustrated in FIG. 10, a relationship between a voltage value (a value corresponding to the resistance value) detected by the displacement sensor 106 and the image area control amount is specified.

In the case where a predetermined voltage is applied to one transparent electrode of the displacement sensor 106, when the voltage value of the other electrode in the state where the display apparatus 100 is not curved is referred to as a reference voltage, the voltage value of the other electrode of the displacement sensor 106 with respect to the reference voltage is increased as the amount of curvature increases. Therefore, by applying the voltage value of the other electrode of the displacement sensor 106 with respect to the reference voltage to the LUT of FIG. 10, it is possible to obtain the image area control amount.

In FIG. 10, the image control amount may refer to an amount by which the maximum size of the display area of the display unit 110 is reduced.

For example, when the detection amount is OV, the image area control amount is not reduced (image area control amount=0). As another example, at an arbitrary point (position) in the displacement sensor 106, a difference of 0.2 V between the voltage detection value of the transparent electrode of the displacement sensor 106 and the reference voltage applied when there is no curvature is detected by the resistance comparing unit 134. In this case, the image area calculating unit 136 calculates the image area control amount in response to the detected difference to allow a "10% reduction" in the image area control amount in the example illustrated in FIG. 10. In addition, the image area control unit 138 performs the image area control to reduce the image area by 10% from the maximum size of the display area of the display unit 110. Also, as another example, when the detection amount is 0.3V, then the maximum size of the display area is reduced by 18% (image area control amount="REDUCTION BY 18%").

As the image area control unit 138 performs the image area control, it is possible to suppress defects that may occur due to a mechanical stress caused by the curvature of the display unit 110 from increasing as the stress is applied while a local current density is loaded for a predetermined output. In addition, it is possible to guarantee stable display performance quality and to ensure visibility during the curvature by reducing the image display area to display images on the part of the display unit 110 which is not curved.

Moreover, the image area control may not be performed in a predetermined range in which the amount of change in resistance is small. For example, as illustrated in FIG. 9, in the predetermined range in which the amount of change in resistance is small, the image area control amount is regarded as 0, and the lookup table may be defined to start the image area control when the amount of change in resistance exceeds a predetermined threshold Th. As described above, a dead zone is provided until the image area control is actually started such that the image area control may not be performed when the display apparatus 100 is slightly curved. Accordingly, the display apparatus 100 does not perform the image area control during a very small deformation, so that the discomfort of the user can be suppressed.

In addition, each parameter of the LUT which defines the relationship between the voltage detected as a result of the comparison in the resistance comparing unit 134 and the image area control amount may be changed to an arbitrary value.

Figure 11:
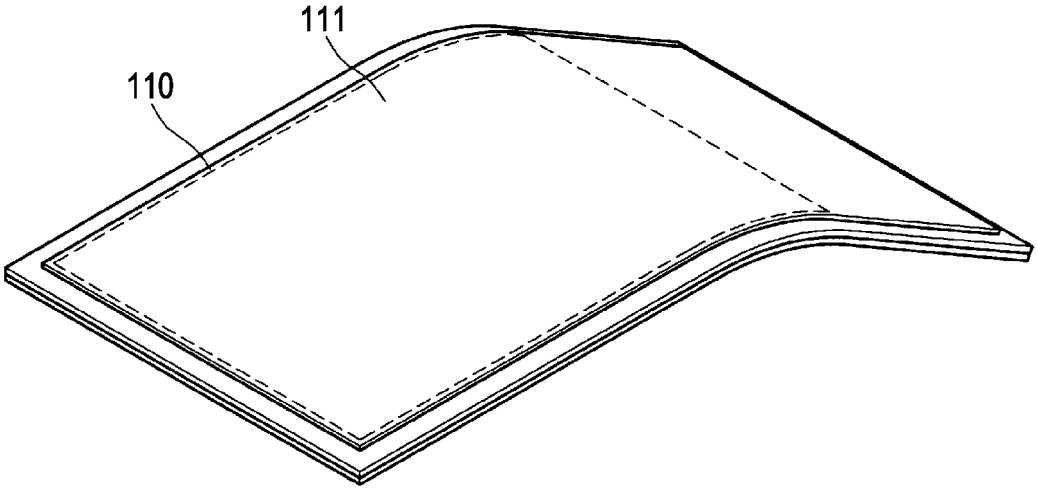
FIG. 11 is a diagram schematically illustrating an example of controlling a size of the image display area of the display unit in response to an amount of curvature of the display apparatus.
Figure 12:
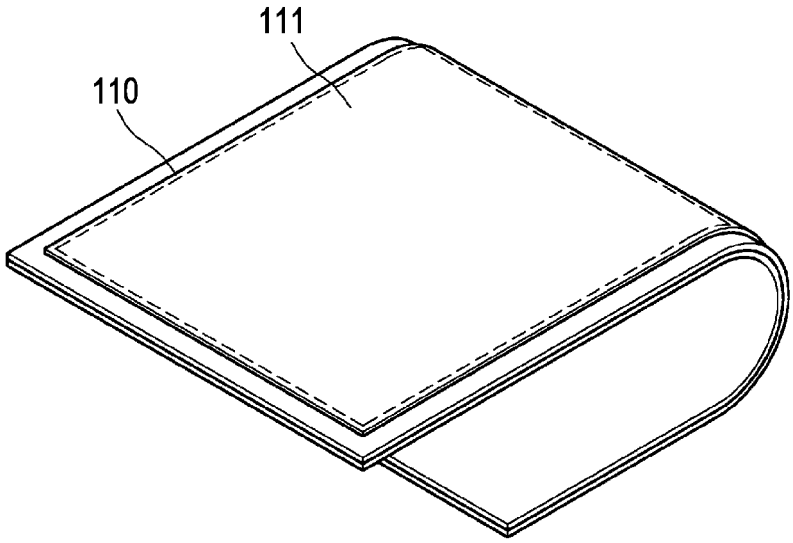
FIG. 12 is a diagram schematically illustrating an example of controlling a size of the image display area of the display unit in response to an amount of curvature of the display apparatus.

FIGS. 11 and 12 are diagrams schematically illustrating states where the sizes of the image display area 111 of the display unit 110 are controlled in response to the amount of curvature of the display apparatus 100 by the image area control unit 138. FIG. 11 schematically illustrates the state where the image display area 111 of the display unit 110 is changed when the display apparatus 100 is slightly curved, and FIG. 12 schematically illustrates the state where the image display area 111 of the display unit 110 is changed when the display apparatus 100 is significantly curved.

When the display apparatus 100 is slightly curved as in FIG. 11, the part of the display apparatus 100 which is not curved is large, so that the size of the image display area 111 of the display unit 110 is controlled by the control unit 130 in response to the amount of curvature of the display apparatus 100 to display images on the part of the display apparatus 100 which is not curved, and thus the entire image to be displayed on the display unit 110 is reduced to be displayed inside the image display area 111.

On the other hand, when the display apparatus 100 is significantly curved as in FIG. 12, the part of the display apparatus 100 which is not curved is small, so that the size of the image display area 111 of the display unit 110 is controlled by the control unit 130 in response to the amount of curvature of the display apparatus 100 to display images on the part of the display apparatus 100 which is not curved, and thus the entire image to be displayed on the display unit 110 is reduced to be displayed inside the image display area 111.

As described above, as the control unit 130 performs the image area control in response to the amount of curvature of the display apparatus 100, the part of the display apparatus 100 which is not curved is used even when the display apparatus 100 is curved so that the entire image to be displayed on the display unit 110 is reduced and displayed inside the image display area 111.

Figure 13:
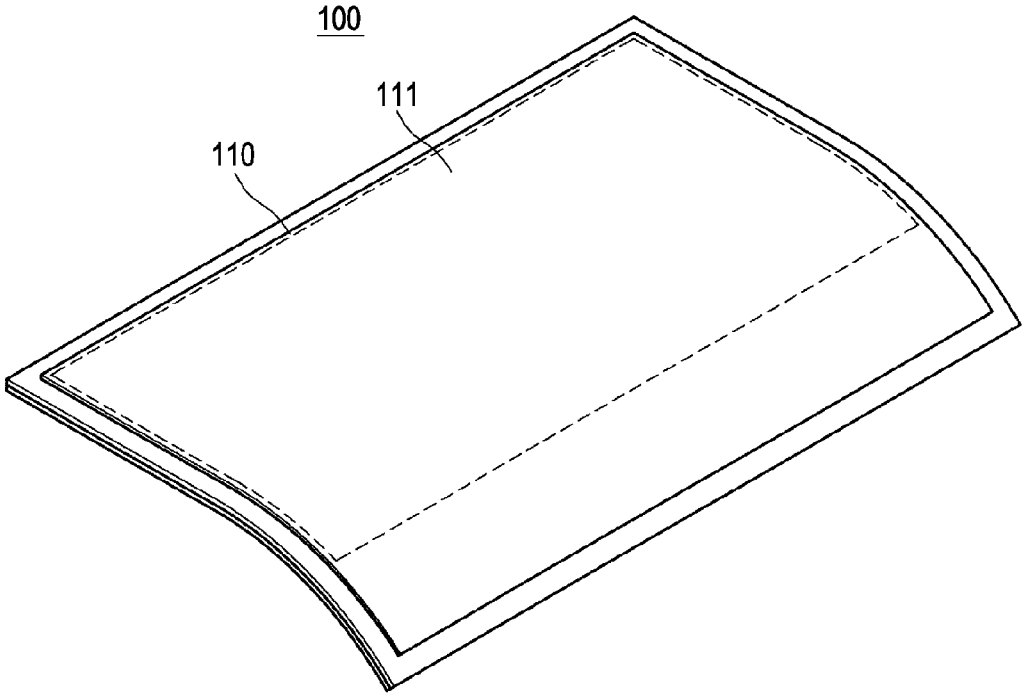
FIG. 13 is a diagram schematically illustrating an example of controlling a size of the image display area of the display unit in response to an amount of curvature of the display apparatus.
Figure 14:
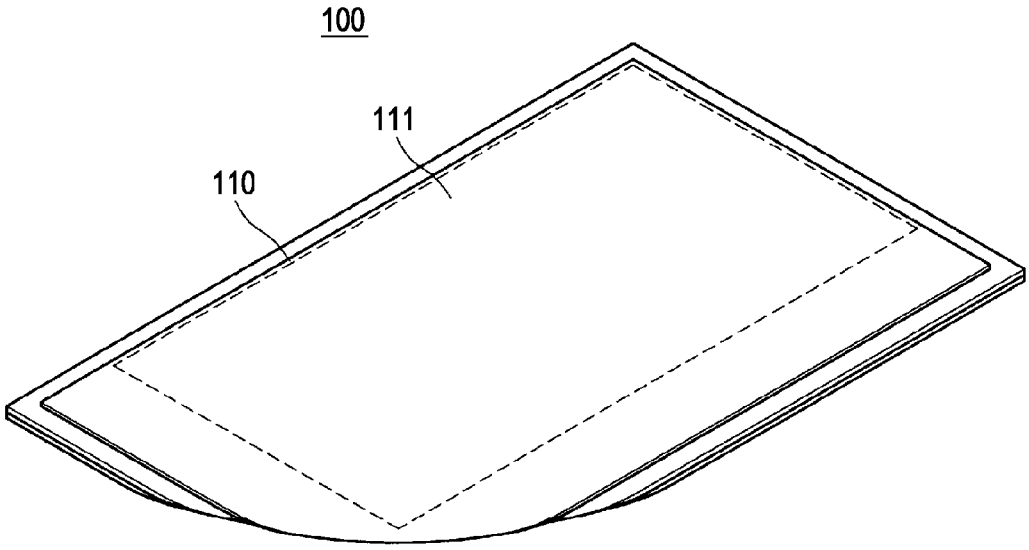
FIG. 14 is a diagram schematically illustrating an example of controlling a size of the image display area of the display unit in response to an amount of curvature of the display apparatus.

Moreover, in this embodiment of the invention, the image area control may be performed by the control unit 130 in response to the curved position of the display apparatus 100. FIGS. 13 and 14 are diagrams schematically illustrating states where the sizes of the image display area 111 of the display unit 110 are controlled in response to the amount of curvature of the display apparatus 100 by the image area control unit 138. Unlike FIG. 11, FIG. 13 schematically illustrates the state where the image display area 111 of the display unit 110 is changed when the display apparatus 100 is curved along its longitudinal side, and FIG. 14 schematically illustrates the state where the image display area of the display unit 110 is changed when a corner of the display apparatus 100 is curved.

In each of FIGS. 11-14, when bent, the display apparatus 100 is such that the concave or convex portion is creaseless.

As such, the image area control may be performed differently by the control unit 130 according to curved points (e.g., the location and/or position of the bending) even with the same amount of curvature. As the image area control is performed depending on the different curved points, the entire image to be displayed on the display unit 110 may be reduced and displayed inside the image display area 111 which is changed depending on the curved points. As described above, since the displacement sensor 106 is provided in the display apparatus 100 in a matrix form, the position of the detected curvature can be acquired by the displacement sensor 106 as well as the amount of curvature.

Figure 15:
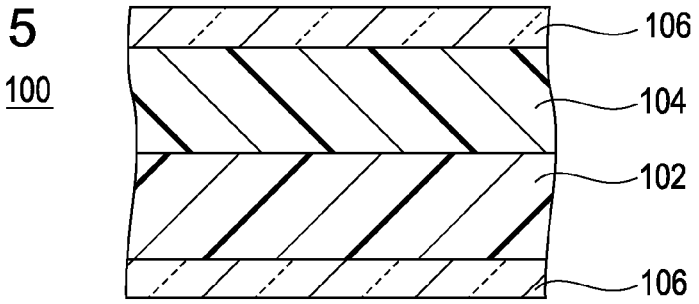
FIG. 15 is a diagram illustrating a cross-section of the display apparatus and schematically illustrating an example of a configuration in which displacement sensors are provided on the front and rear surfaces of the display apparatus.
Figure 16:
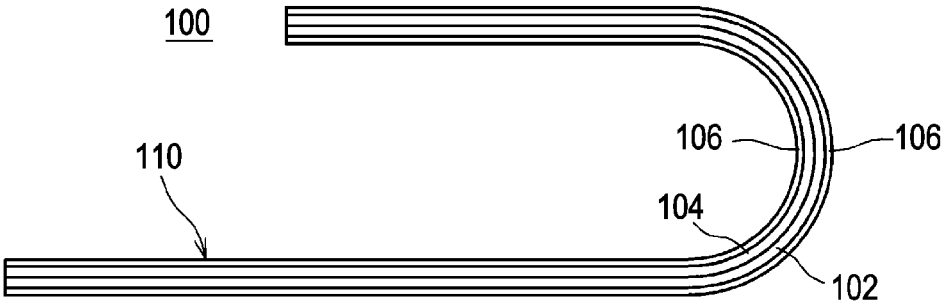
FIG. 16 is a diagram schematically illustrating a curved state of the display apparatus illustrated in FIG. 15.

4. Example of Configuration Providing Displacement Sensors on Front and Rear Surfaces FIG. 15 is a diagram schematically illustrating the cross-section of the display apparatus 100 and illustrates an example of a configuration in which displacement sensors are provided on the front and rear surfaces of the display apparatus 100. In addition, FIG. 16 is a diagram schematically illustrating a curved state of the display apparatus 100 illustrated in FIG. 15. In the case of FIG. 16, with regard to the curved part, the radius of curvature of the displacement sensor 106 on the rear surface where the display unit 110 is not provided is greater than that of the displacement sensor 106 on the front surface where the display unit 110 is provided. More specifically, the radius of curvature of the displacement sensor 106 on the rear surface is increased by the thicknesses of the first and second substrates 102 and 104. Therefore, the radius of curvature of the displacement sensor 106 on the front surface is greater than that of the displacement sensor 106 on the rear surface, so that the amount of change in resistance of the displacement sensor 106 on the front surface with a larger amount of curvature is greater than that of the displacement sensor 106 on the rear surface.

Therefore, in the configuration illustrated in FIG. 15, when the amounts of change in resistance are detected by the displacement sensors 106 on the front and rear surfaces, by comparing the amounts of change in resistance on the front and rear surfaces to each other, it is possible to detect which one is a concave surface from among the front and rear surfaces with the other being a convex surface. In addition, when the front surface is the concave surface, the display unit 110 is hidden from the outside as compared with the case where the front surface is the convex surface, so that it becomes more difficult to recognize the display unit 110. Therefore, in order to increase visibility of the image displayed on the display unit 110, the image area control amount is increased. On the other hand, when the front surface is the convex surface, there is curvature in the image. However, since the front surface has higher visibility in the image itself as compared with the case of the rear surface, the image area control amount is reduced as compared with the case where the front surface is the concave surface. Therefore, even with the same amount of curvature, it is possible to change the size of the image display area between the cases where the front surface is the convex surface and concave surface.

5. Another Example of Lookup Table

Figure 17:
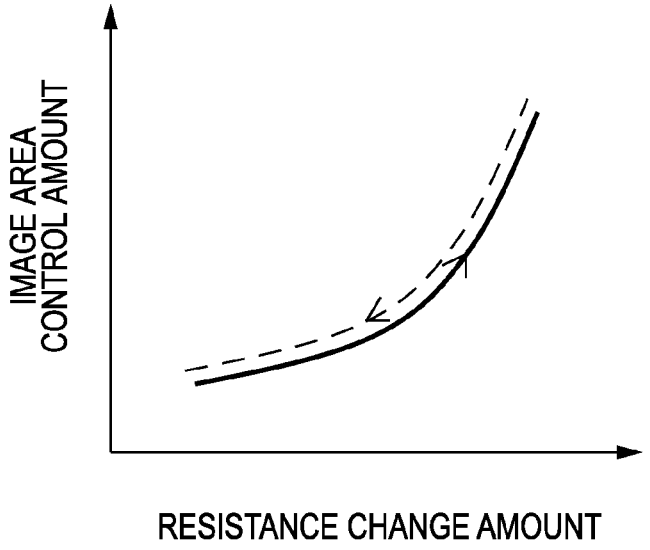
FIG. 17 is a diagram corresponding to information provided by another example of the lookup table.

FIG. 17 is a diagram that graphically represents information corresponding to another example of the lookup table. In the example illustrated in FIG. 17, in a process of bending the display apparatus 100 and in a process of returning the curved display apparatus 100 to another state (e.g., unbent state), the image area control amount for the amount of change in resistance is changed.

In FIG. 17, a characteristic curve (indicated by a solid line in FIG. 17) corresponds to the process of bending the display apparatus 100. On the other hand, in the process of being returned to an unbent state from the curved state, a characteristic curve is indicated by a dashed line in FIG. 17.

In FIG. 17, the image area control amount may refer to an amount of change in the size of the selected image display area with respect to the maximum size of the display area of the display unit. For example, when the change in resistance is a small value (or at a predetermined threshold value such as Th), then the image control amount is a relatively small amount (or may be defined to be zero for changes in resistance values less than or equal to Th) and the amount of change of the size of the selected display area with respect to the maximum size of the display area is relatively small (or may be zero if the change in resistance values is less than or equal to Th). In other words, in such a case, the difference between the maximum size and the selected display area may be a relatively small amount (or may be set to zero). However, when the change in resistance values is relatively large, then the display area experiences a greater amount of change in size with respect to the maximum size of the display area, as shown in FIG. 17. In this case, a greater resistance change amount may correspond to a greater change in the size of the display area from its maximum size.

For the area with a large amount of change in resistance, a change in the image area control amount for the amount of change in resistance can be further increased, and for the area with a small amount of change in resistance, the change in the image area control amount for the amount of change in resistance can be further reduced, so to thereby increase the speed of change in the display area when the display is in the process of being bent or unbent. Accordingly, during the process of returning to an unbent state from the curved state, it is possible to more rapidly return the image to its original state by the image area control. Therefore, when the curved display apparatus 100 is returned to a flat surface (e.g., unbent state), it is possible to reliably suppress discomfort of the user due to the image area control.

While exemplary embodiments of the present invention have been described in detail with reference to the accompanying drawings, the present invention is not limited to these embodiments. It should be understood by those skilled in the art that various modifications and alterations can be made within the spirit of the appended claims and they belong to the scope of the present invention.

What is claimed is:

1. An apparatus, comprising:

a bendable substrate that when bent has a curved portion and an uncurved portion, the uncurved portion including a planar portion of the substrate, the curved portion (a) being that portion of the substrate bent away from the planar portion by more than a predetermined threshold and (b) comprising a concave or convex portion;

light-emitting elements carried on the substrate;

a plurality of sensors, each of which is configured to detect bending of the substrate; and a display controller configured to control the light-emitting elements at least in part based upon the bending of the substrate detected by the plurality of sensors, wherein, each sensor comprises a transparent electrode and is configured to detect a location of the curved portion, the substrate is configured to be freely bent such that the curved portion is enabled to occur at any position along the substrate, the display controller is configured to control the light-emitting elements to provide a display area of active light-emitting elements, the display controller is configured to confine the display area to the uncurved portion when the curved portion is detected and surfaces of the curved and uncurved portions do not overlap, and the display controller is configured to control a size of an image to match the size of the display area so that all content of the image is displayed in the display area regardless of the size of the display area.

2. The apparatus of claim 1, wherein a first sensor is configured to detect an amount of bending of the substrate.

3. The apparatus of claim 2, wherein the display controller controls the size of the display area based upon the amount of bending of the substrate detected by the first sensor.

4. The apparatus of claim 3, wherein the display controller is configured to reduce the size of the display area in accordance with the amount of bending detected such that a larger degree of bending corresponds to a smaller display area than a smaller degree of bending.

5. The apparatus of claim 2, further comprising:

another bendable substrate aligned with the substrate; and a second sensor configured to detect bending of the another substrate, wherein, the display controller also controls the light-emitting elements at least in part based upon the bending of the another substrate detected by the second sensor.

6. The apparatus of claim 5, wherein:

the display controller is configured to determine if a first side of the substrate is concave or convex based on the bending of the substrate, the determination being based on a comparison between a result detected by the first sensor and a result detected by the second sensor; and the display controller is configured to control the size of the display area based upon the determination.

7. The apparatus of claim 6, wherein the display controller is configured to control the size of the display area differently when the first side is determined to be convex than when the first side is determined to be concave.

8. The apparatus of claim 1, wherein the display controller is configured to control the size of the display area such that a rate of changing the size of the display area is increased when the substrate transitions from the bent state to a flat state relative to when the substrate transitions from the flat state to the bent state.

9. The apparatus of claim 1, wherein the concave or convex portion is creaseless.

10. A display apparatus, comprising:

a display unit having a display area to display at least one image, the display unit including:

(a) a bendable substrate having a first side and a second side that is opposite to the first side, the substrate that when bent has a curved portion and an uncurved portion, the uncurved portion including a planar portion of the substrate, the curved portion (i) being that portion of the substrate bent away from the planar portion by more than a predetermined threshold and (ii) comprising a concave or convex portion;

(b) light-emitting elements carried on the substrate; and (c) a plurality of sensors, each of which is configured to detect bending of the substrate; and a display controller configured to control the light-emitting elements at least in part based upon the bending of said substrate detected by the plurality of sensors, wherein, each sensor comprises a transparent electrode and is configured to detect a location of the curved portion, the substrate is configured to be freely bent such that the curved portion is enabled to occur at any position along the substrate, the display controller is configured to control the light-emitting elements to provide the display area of active light-emitting elements, the display controller controls a size of the display area in accordance with the location of the curved portion, the display controller is configured to control the size of the display area differently for a same amount of curvature when the first side is determined to be convex than when the first side is determined to be concave, and the display controller is configured to control a size of an image to match the size of the display area so that all content of the image is displayed in the display area regardless of the size of the display area.

11. The display apparatus of claim 10, wherein each sensor is configured to detect an amount of bending of the substrate.

12. The display apparatus of claim 10, wherein the display controller is configured to control the size of the display area such that a rate of changing the size of the display area is increased when the display unit transitions from the bent state to a flat state relative to when the display unit transitions from the flat state to the bent state.

13. The display apparatus of claim 10, wherein the concave or convex portion is creaseless.

14. A display apparatus comprising:

a display unit having a display area to display at least one image, said display unit including:

a bendable substrate configured to bend and flex into a number of different positions and that when bent has a curved portion and an uncurved portion, the uncurved portion including a planar portion of the substrate, the curved portion (a) being that portion of the substrate bent away from the planar portion by more than a predetermined threshold and (b) comprising a concave or convex portion;

display elements carried on said substrate; and a plurality of sensors, each of which is configured to detect a location of the curved portion, wherein, each sensor comprises a transparent electrode, the substrate is configured to be freely bent such that the curved portion is enabled to occur at any position along the substrate, the display area comprises active display elements on a display surface, a size of the display area is controlled based upon the location of curved portion along the substrate, the display area is confined to the uncurved portion when the curved portion is detected and surfaces of the curved and uncurved portions do not overlap, and a size of an image is controlled to match the size of the display area so that all content of the image is displayed regardless of the size of the display area.

15. The display apparatus of claim 14, wherein the display area of the active display elements includes active light-emitting elements.

16. The display apparatus of claim 14, wherein the size of the display area is controlled such that a rate of changing of the size of the display area is increased when the display unit transitions from the bent state to a flat state relative to when the display unit transitions from the flat state to the bent state.

17. The display apparatus of claim 14, wherein the concave or convex portion is creaseless.

18. A method for controlling a display unit, said method comprising:

detecting, by each of a plurality of sensors of the display unit, a location of bending that is enabled to occur at any position on a bendable substrate of the display unit, the substrate when bent has a curved portion and an uncurved portion, the uncurved portion including a planar portion, the curved portion (a) being that portion of the substrate bent away from the planar portion by more than a predetermined threshold and (b) comprising a concave or convex portion;

controlling light-emitting elements to provide a display area of active light-emitting elements; and controlling a size of the display area in part based upon the location of the curved portion along the substrate; and controlling a size of an image to match the size of the display area so that all content of the image is displayed regardless of the size of the display area, wherein, each sensor comprises a transparent electrode, and the display area is confined to the uncurved portion when the curved portion is detected and surfaces of the curved and uncurved portions do not overlap.

19. The method of claim 18, further comprising:

detecting bending of another bendable substrate of the display unit; and controlling the size of the display area of the active light-emitting elements at least in part based upon the bending of the another substrate.

20. The method of claim 19, further comprising:

determining if a first side of the substrate is concave or convex based on the bending of the substrate, the determination being based on a comparison between a result detected by a first sensor regarding the bending of the substrate and a result detected by a second sensor regarding the bending of the another substrate; and controlling the size of the display area of the active light-emitting elements at least in part based upon the determination.

21. The method of claim 18, wherein the bending of the substrate is detected by each sensor that includes opposed electrodes, and the detecting includes:

applying a predetermined voltage to one of the electrodes; and monitoring a resistance value between the electrodes.

22. The method of claim 21, further comprising:

comparing the resistance value of each sensor with a reference resistance value, the reference resistance value being a resistance value of the substrate in an unbent state;

calculating a difference between the resistance value of each sensor and the reference resistance value; and setting the size of the display area of the active light-emitting elements in relationship to the calculated amount.

23. The method of claim 22, wherein:

if the calculated amount is not greater than a threshold value, then the size of the display area is not reduced; and if the calculated amount is greater than the threshold value, then the size of the display area is changed.

24. The method of claim 18, further comprising:

controlling the size of the display area such that a rate of changing the size of the display area is increased when the display unit transitions from the bent state to a flat state relative to when the display unit transitions from the flat state to the bent state.

25. The method of 18, wherein the concave or convex portion is creaseless.

* * * * *